United States Patent [19]

Settembre

[11] 4,219,216

[45] Aug. 26, 1980

[54] NORDIC SKI BINDING

[76] Inventor: Richard J. Settembre, 714 Velasko Rd., Syracuse, N.Y. 13207

[21] Appl. No.: 20,794

[22] Filed: Mar. 15, 1979

[51] Int. Cl.[3] ..... A63C 9/086

[52] U.S. Cl. ..... 280/615; 280/631

[58] Field of Search ..... 280/615, 614, 631, 618

[56] References Cited

U.S. PATENT DOCUMENTS

| | | | |
|---|---|---|---|
| 3,233,911 | 2/1966 | Miller | 280/631 |
| 3,874,684 | 4/1975 | Dysthe | 280/615 |
| 3,979,131 | 9/1976 | Ginther | 280/615 |
| 4,032,172 | 6/1977 | Pyzel et al. | 280/615 |
| 4,082,312 | 4/1978 | Johnson | 280/615 |

*Primary Examiner*—David M. Mitchell

*Attorney, Agent, or Firm*—Bruns & Jenney

[57] ABSTRACT

A cross country ski binding that includes a toe piece affixed to the boot of a skier which is slidably received within an open sided base section secured to the ski. A rocker bar is rotatably mounted in the base that contains a pair of downwardly extended, contoured lugs that are adapted to be received in openings formed in the top surface of the toe piece. An adjustable biasing means acts upon the rocker bar to pressure the lugs against the front face of the receiving openings. The front wall surface of the toe piece is arrested against the base section and is arranged to pivot laterally in either direction about its two side edges so that the toe piece can be freed from the ski piece in the event the skier overcomes the holding pressure exerted by the lugs upon the toe piece.

10 Claims, 7 Drawing Figures

NORDIC SKI BINDING

BACKGROUND OF THE INVENTION

This invention relates to a cross country ski binding and, in particular, to an improved cross country binding for protecting the user against injury.

Touring or cross country skis are relatively long and narrow devices that are specifically designed to enable the skier to glide easily over relatively flat terrain. Typically, the toe of the boot is securely locked to the ski by either cable or pin bindings which will not release in the event the skier falls. Cross country skiing has, until recently, been thought to be a relatively safe form of recreation. However, a survey of skiing accidents over the last few years points to a disturbingly large number of injuries resulting from this activity. Most of these injuries result from lateral falls wherein the skier experiences a slow turning fall to one side or the other of the skis. Because of the configuration of the ski, the ski can be caught in the snow and, as a consequence, will promote a holding force acting against the skier's leg. A twisting stress is thus generated in the leg as the skier approaches the ground which, if not relieved, will result in an injury.

A safety binding for preventing injury due to a slow turning fall is disclosed in U.S. Patent application Ser. No. 925,096, now U.S. Pat. No. 4,184,696, which was filed July 17, 1978 in the name of the present applicant. This application is an improvement of the ski binding disclosed in the prior application.

SUMMARY OF THE INVENTION

It is therefore an object of the present invention to improve the bindings used in cross country skiing.

Another object of the present invention is to provide a simple yet inexpensive safety binding for use in cross country skiing.

A still further object of the present invention is to provide a low profile cross country safety binding that is convenient, safe and easy to use.

Yet another object of the present invention is to provide an improved cross country ski binding having an adjustable release pressure.

These and other objects of the present invention are attained by means of a cross country ski binding that includes a toe piece affixed to the skier's boot and an open-sided base section secured to the ski for slidably receiving the toe piece therein. A rocker bar is rotatably mounted in the base section that contains downwardly extended contoured lugs that pass into top openings formed in the toe piece. In assembly each lug bears against an inclined wall provided in the opening. A biasing means acts upon the rocker bar to pressure the lugs against the receiving wall. The front wall of the toe piece is arrested against the base section so that it can turn laterally about its side edges to pull the lugs free of the receiving openings in the event the skier overcomes the holding pressure delivered by the biasing means. The lugs and the receiving walls of the opening are strategically positioned to facilitate accurate and repeatable releasing of the toe piece from the ski.

BRIEF DESCRIPTION OF THE DRAWINGS

For a better understanding of these and other objects of the present invention reference is had to the following detailed description of the invention which is to be read in conjunction with the accompanying drawings, wherein.

DESCRIPTION OF THE INVENTION

Figure 1:
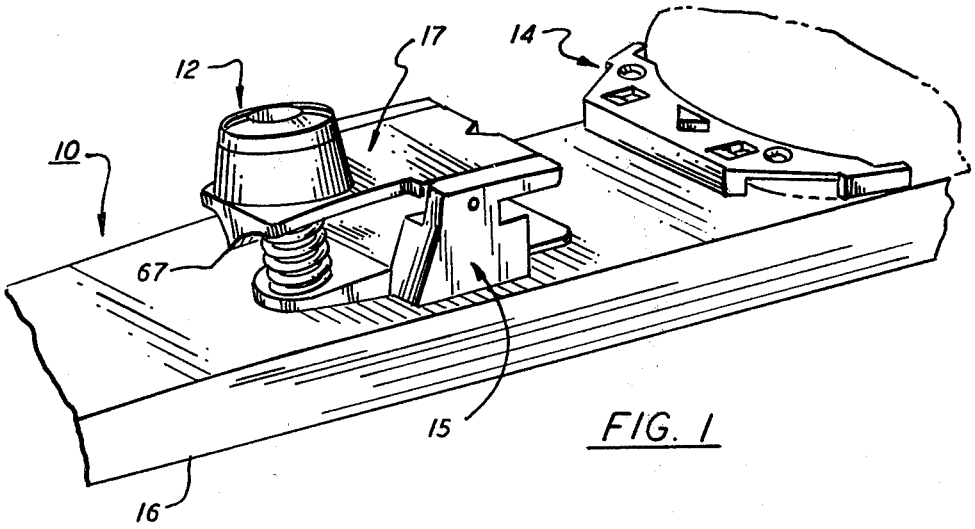
FIG. 1 is a perspective view showing a ski binding embodying the teachings of the present invention which illustrates the toe piece of the binding separated from the ski piece.

Referring now to the drawings, the ski binding of the present invention, which is generally referenced 10, is made up of a boot mounted toe piece 12 and a ski mounted piece 14. The ski piece includes a base section 15 that is affixed to the top surface of ski 16 and a rocker bar 17 rotatably supported in the base section upon a horizontal pin 18. As will be explained in further detail below, the toe piece is adapted to be slidably received within the base section of the ski piece and is held in assembly under a pressure provided by the rocker bar.

The toe piece includes a vertical front wall 20 of planar configuration that is perpendicularly joined to a horizontal top surface 21. The body of the toe piece is contoured to conform to the front of a ski boot 22 thus enabling the piece to rest upon the front sole portion of the boot. Side wings 23—23 can also be provided on the toe piece to further facilitate its mounting upon the boot. A pair of holes 24—24 are passed through the top surface of the toe piece in which mounting screws (not shown) are securely seated to hold the toe piece in centered alignment with the longitudinal axis of the boot.

Figure 6:
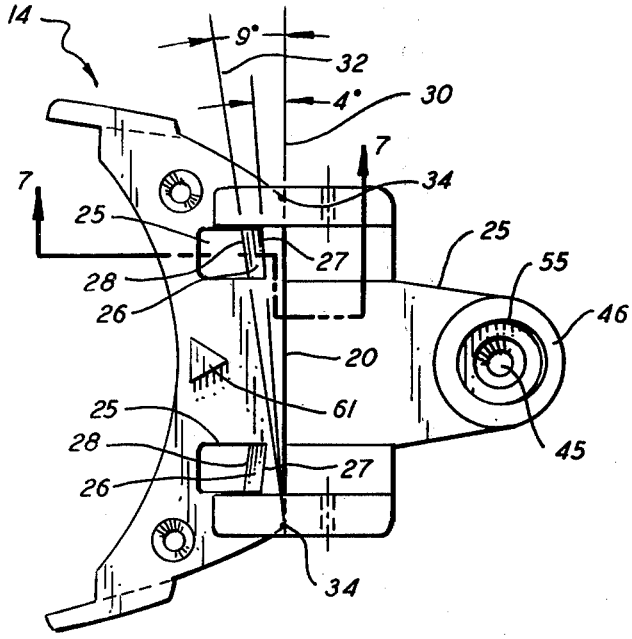
FIG. 6 is a top view showing the toe piece operatively mounted within the base section of the binding with the rocker bar being removed to more clearly illustrate the interrelationship of the two elements.
Figure 7:
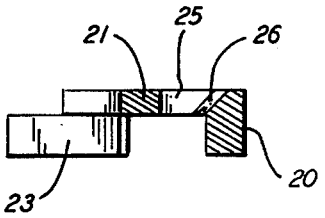
FIG. 7 is a section taken along lines 7—7 in FIG. 6 showing the geometry of the openings formed in the toe piece.

With specific reference to FIGS. 6 and 7, a pair of openings 25—25 are formed in the top surface of the toe piece. The openings are generally rectangular in form and are set back some distances from the front vertical wall of the toe piece. The openings are positioned an equal distance on either side of the central axis of the toe piece to provide the piece with a symmetrical configuration. The front face 26—26 of each opening slopes rearwardly from its top edge 27—27 toward its bottom edge 28—28 and is also obliquely offset in reference to the front wall 20. The slope of the front face is preferably about 45°. As best illustrated in FIG. 6, the top edge of the front face and its bottom edge lie upon lines 30 and 32, respectively, that pass through a vertical line 34 describing the side edge of the front wall which is furthest away from the opening. As shown, the top edge of the front face forms an angle of about 4° with the vertical front wall of the toe piece while the bottom edge makes an angle of about 9° therewith.

The base section 15 of the ski piece includes a pedestal 25 from which rise two spaced-apart side walls 36—36. The side walls are of similar construction with each wall containing a horizontal ledge 37—37 formed along its inner wall and a horizontally aligned tab 38—38 extending outwardly from its front surface. The front surface of each side wall is cut back an equal distance to provide a vertical arresting wall 40—40. The two arresting walls coact in assembly so that each will receive in bearing contact thereagainst one of the vertical edges 34 of the front wall of the toe piece.

The pedestal of the base section is secured to the ski via two front screws 41—41 adapted to pass downwardly through holes 42—42 and a single rear screw 43 passing downwardly through hole 45 formed in the center of raised embossment 46.

When assembled, each of the tabs 38—38 will be positioned over the top wall of the toe piece to prevent unwanted vertical displacement of the toe piece within the ski piece. Sufficient lateral spacing is provided between the tabs to enable the tabs to be positioned adjacent to the outside margins of the two openings 25—25 as shown in FIG. 6. As will be explained in greater detail below, aligning means are provided which serve to locate the toe piece within the ski piece whereby the tabs are accurately positioned in reference to the openings in assembly.

Figure 4:
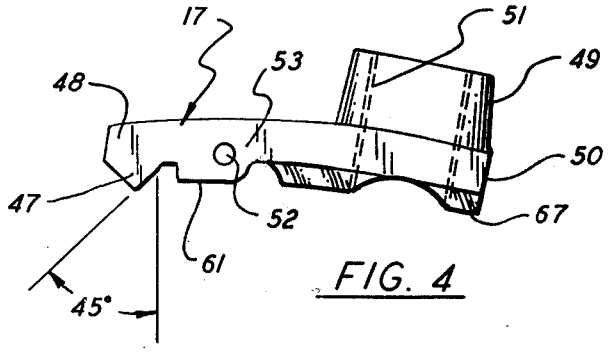
FIG. 4 is a side view of a rocker bar which is mounted in the base section of the ski piece.
Figure 5:
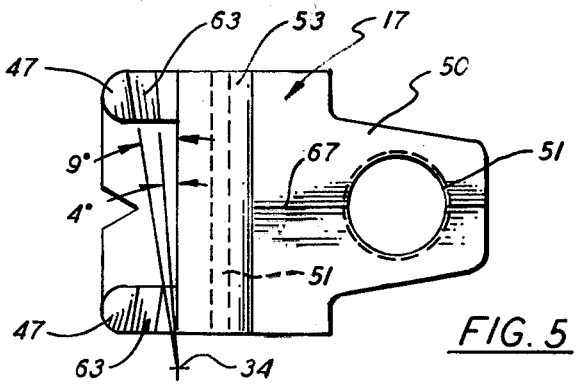
FIG. 5 is a bottom view of the rocker bar shown in FIG. 4 illustrating the contour of the lugs depending therefrom.

Rocker bar 17 is pivotably supported between the side walls of the base section by means of the noted pin 18 so that the bar is able to rotate in a generally vertical plane. As best illustrated in FIGS. 4 and 5, a pair of lugs 47—47 depend downwardly fron the bottom of the horizontally-extended front leg 48 of the bar. The lugs are arranged to be received within the openings formed in the top surface of the toe piece when the toe piece is inserted into the ski piece. A raised flange 49 extends upwardly from the top of the opposite horizontally-extended rear leg 50 of the bar. A threaded hole 51 is passed through both the large and the rear leg of the bar. A smaller straight through hole 52, for receiving pin 18, is passed laterally through the deepened body 53 of the bar.

Figure 2:
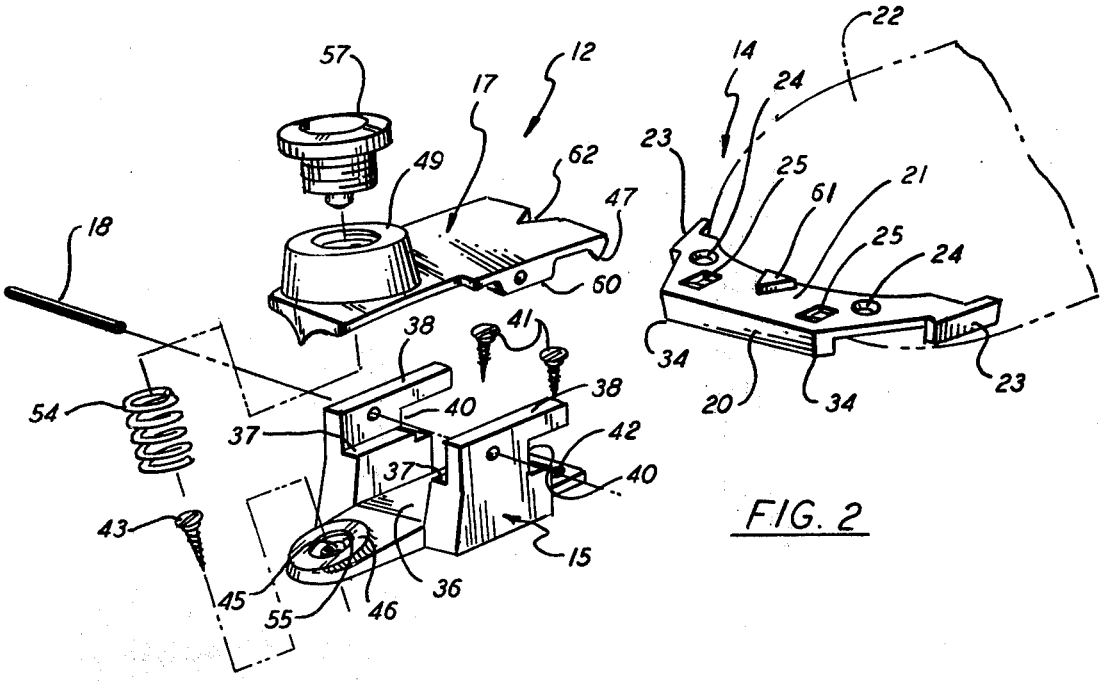
FIG. 2 is an exploded view of the ski binding shown in FIG. 1.
Figure 3:
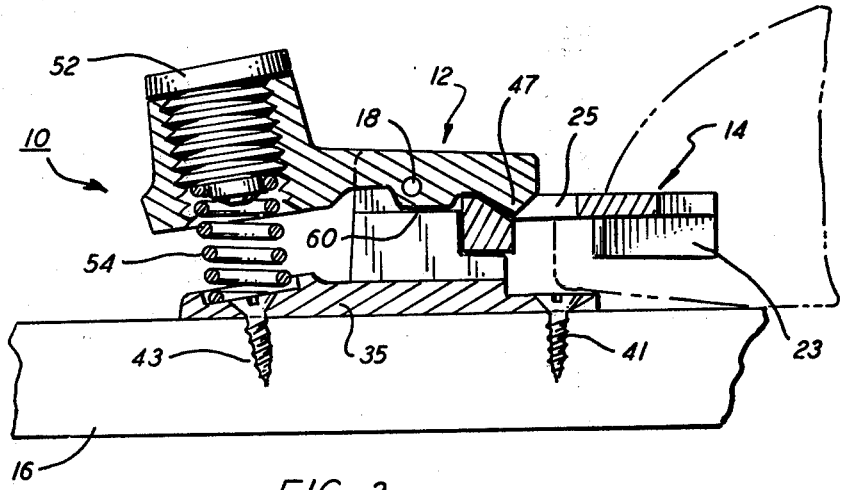
FIG. 3 is a side elevation in section of the ski binding shown in FIG. 1 illustrating the toe piece operatively connected to the ski piece of the binding.

Turning now more specifically to FIGS. 2 and 3, a biasing means in the form of a compression spring 54 is arranged to act between the base section and the rocker arm to continually bias the lugs in a clockwise direction. The spring is seated within a cup-like opening 55 formed in the raised embossment 46 and is arranged to pass upwardly into the threaded hole 51 provided in the back of the rocker bar. An adjusting cap 57, of any suitable design, is threaded downwardly through the flange 49 into compressing engagement with the spring to preload the spring in assembly.

A flat 60 is formed along the bottom of the rocker bar that seats against the ledges 37—37 formed in the side walls of the base section. The flat coacts with the ledges to create a stop that limits the extent to which the rocker bar can be rotated in a clockwise direction. When in the stop position, the lugs are supported at an elevation such that the top edge of the toe piece can be brought into contact with the rounded front surfaces thereon. Exerting a forward pressure upon the lugs with the toe piece causes the rocker bar to be rotated in a counterclockwise direction thus lifting the lug sufficiently to permit the toe piece to slide thereunder.

A locating means for aligning the toe piece as it moves into the ski piece is herein provided. The locating means includes a triangular-shaped appendage 61 carried upon the top surface of the toe piece with its apex pointing toward the front wall thereof. The appendage is adapted to move into a V-like notch 62 formed in the front of the rocker bar to accurately align the lugs with the openings formed in the top of the toe piece. The aligning means also serves a second important function in that it causes the two side edges of the toe piece to be positioned in bearing contact against the two surfaces 40—40 making up the arresting wall of the base section.

The back or working surfaces 63—63 of the lugs are generated to compliment the front faces of the receiving openings 25—25. As illustrated in FIGS. 4 and 5, each working surface is inclined at about a 45° angle from top to bottom and is angularly turned from a line 34 describing the far side edge position taken by the toe piece in assembly. Accordingly, the working surface of each lug, because it complements the front face of the receiving opening, is able to be seated in intimate contact against the front face of the opening as shown in FIG. 3 when the front of the toe piece is positioned against the arresting wall.

In operation, when the skier experiences a slow turning fall to either side of the skis, a turning force is generated in the binding about the side edge 34 of the toe piece to the side of the fall. Because of the geometry of the binding, the lug furthest from the turning edge begins to ride up the front face of the corresponding receiving opening thereby forcing the rocker bar back against the forward biasing pressure of the compression spring. When the spring pressure is overcome, the lug will be released from the opening and caused to ride upon the top surface of the toe piece. The other lug, which is nearest to the turning edge, must follow the path prescribed by the first lug and is thus also freed from its received opening. As a result, the toe piece is rotated laterally out of the ski piece thus releasing the binding. By adjusting the elevation of the threaded cap, the loading provided by the spring can be regulated to thus set the release pressure at a desired level for the skier's weight and/or skiing ability.

To remove the toe piece from the ski piece under normal conditions, the skier simply places his ski pole against the threaded cap and pushes downwardly to overcome the holding force of the spring whereupon the lugs are pulled back out of the receiving openings. The bottom surface of the rear leg of the rocker bar is brought to a knife edge configuration 67 which enables the bar to cut downwardly through any ice or snow which might have built up under the bar.

While this invention has been described with reference to the structure disclosed herein, it is not confined to the details set forth and this application is intended to cover any modifications or changes as may come within the scope of the following claims.

What is claimed is:

1. A cross country ski binding that includes a toe piece adapted to be attached to the forward end of the ski book having a vertical front wall whose side edges lie upon vertically extended lines, a horizontal top wall, and a pair of openings passing downwardly through the top wall that are equally spaced on either side of the central axis of the toe piece, the front face of each opening being planar in form and sloping toward the heel of the ski boot from its top edge towards its bottom edge and each face being angularly offset with reference to said front wall to turn the faces outwardly from central axis, a ski piece that includes an open sided base section for slidably receiving the toe piece therein to limit vertical movement of said toe piece and having an arresting wall against which the two side edges of the front wall of the toe piece rest in contact, a rocker bar mounted in the base section for rotation within a vertical plane, said rocker bar having a forwardly extended leg that is arranged to pass over the top wall of the toe piece and which contains a pair of lugs having working surfaces thereon which compliment the front faces of said toe piece openings and which are arranged to rest in contact therewith when the front wall of the toe piece is contacting the arresting wall of the base section, and biasing means acting upon the rocker bar for urging the working surfaces of said lugs into pressure contact against the front faces of said receiving openings.

2. The binding of claim 1 wherein said rocker bar has a rearwardly extended leg and said biasing means is a compression spring arranged to act between said rear leg and the base section of the ski piece.

3. The binding of claim 1 that further includes an adjusting means for regulating the amount of pressure exerted by the biasing means against the rocker bar.

4. The binding of claim 2 that further includes a stop means for limiting the extent of movement afforded the lugs in a direction toward said openings.

5. The binding of claim 1 that further includes locating means for positioning the toe piece within the ski piece whereby the lugs are aligned with reference to said openings.

6. The binding of claim 5 wherein said base section includes at least one horizontally extended tab that is arranged to pass over the top wall of the toe piece in close sliding relationship therewith.

7. The binding of claim 6 that includes two tabs that are arranged to be positioned adjacent to the outside margins of said openings when the toe piece is aligned within the ski piece.

8. The binding of claim 2 wherein the bottom surface of said rearwardly extended leg of the rocker bar is brought to a downwardly pointed knife edge.

9. The binding of claim 1 wherein the top edge and the bottom edge of each front face lies upon a line that passes through the line describing the side edge of the front wall furthest from the opening.

10. The binding of claim 9 wherein the top edge of each front face makes an angle of about 4° with the front wall of the toe piece and the bottom edge of said front face makes an angle of about 9° with the front wall.

* * * * *

UNITED STATES PATENT AND TRADEMARK OFFICE

CERTIFICATE OF CORRECTION

PATENT NO. : 4,219,216
DATED : August 26, 1980
INVENTOR(S) : RICHARD J. SETTEMBRE It is certified that error appears in the above-identified patent and that said Letters Patent are hereby corrected as shown below:

Claim 1, Col. 4, line 58, "ski book" should be

-- ski boot --.

Signed and Sealed this

*Ninth* Day of *December 1980*

[SEAL]

*Attest:*

SIDNEY A. DIAMOND

*Attesting Officer*

*Commissioner of Patents and Trademarks*